US005078893A

United States Patent [19]

Ryer et al.

[11] Patent Number: 5,078,893

[45] Date of Patent: Jan. 7, 1992

[54] SYNERGISTIC COMBINATION OF ADDITIVES USEFUL IN POWER TRANSMITTING COMPOSITIONS

[75] Inventors: Jack Ryer, East Brunswick; Antonio Gutierrez, Mercerville, both of N.J.

[73] Assignee: Exxon Chemical Patents Inc., Linden, N.J.

[21] Appl. No.: 210,830

[22] Filed: Jun. 24, 1988

[51] Int. Cl.[5] ..... C10M 137/02

[52] U.S. Cl. ..... 252/49.6; 252/49.8; 252/51.5 R; 252/51.5 A; 252/77; 252/78.5

[58] Field of Search ..... 252/49.6, 49.8, 51.5 R

[56] References Cited

U.S. PATENT DOCUMENTS

| | | | |
|---|---|---|---|
| 2,151,300 | 3/1939 | Moran et al. | 252/49.9 |
| 2,917,160 | 12/1959 | Turinsky | 72/42 |
| 3,034,907 | 5/1962 | Kleemann et al. | 252/475 |
| 3,186,946 | 6/1965 | Sluhan | 252/34.7 |
| 3,254,025 | 5/1966 | Le Suer | 252/32.7 E |
| 3,484,375 | 12/1969 | Hu | 252/49.9 |
| 3,502,677 | 3/1970 | Le Suer | 252/32.5 |
| 3,509,052 | 4/1970 | Murphy | 252/34.7 |
| 3,513,093 | 5/1970 | Le Suer | 252/32.5 |
| 3,645,886 | 2/1972 | Gillespie et al. | 252/68 |
| 3,702,300 | 11/1972 | Coleman | 252/51.5 A |
| 3,711,406 | 1/1973 | Lowe | 252/33.4 |
| 3,933,659 | 1/1976 | Lyle et al. | 252/32.7 E |
| 4,116,877 | 9/1978 | Outten et al. | 252/72 |
| 4,129,508 | 12/1978 | Friihauf | 252/33 |
| 4,170,560 | 10/1979 | Lowe | 252/47.5 |
| 4,231,883 | 11/1980 | Malec | 252/33.4 |
| 4,382,006 | 5/1983 | Horodysky | 252/49.6 |
| 4,409,000 | 10/1983 | Le Suer | 252/51.5 A |
| 4,486,324 | 12/1984 | Korosec | 252/49.3 |
| 4,529,528 | 7/1985 | Horodysky | 252/49.6 |
| 4,557,845 | 12/1985 | Horodysky et al. | 252/49.9 |
| 4,557,849 | 12/1985 | Eckert | 252/51.5 R |
| 4,594,171 | 6/1986 | Horodysky et al. | 252/49.6 |
| 4,634,543 | 6/1987 | Okada et al. | 252/78.5 |
| 4,681,694 | 7/1987 | Zoleski et al. | 252/51.5 R |
| 4,704,217 | 11/1987 | Sweeney et al. | 252/32.7 E |

FOREIGN PATENT DOCUMENTS

| | | |
|---|---|---|
| 0152677A3 | 8/1985 | European Pat. Off. . |
| 1299534 | 7/1961 | France . |
| 2172131 | 1/1973 | France . |
| WO88/03554 | 5/1988 | PCT Int'l Appl. . |
| 823295 | 11/1959 | United Kingdom . |

*Primary Examiner*—Prince Willis, Jr.
*Assistant Examiner*—Ellen McAvoy
*Attorney, Agent, or Firm*—R. A. Maggio

[57] ABSTRACT

A mutually compatible combination of additives and their use to impart anti-wear, oxidation inhibition and friction modification to power transmission compositions, particularly automatic transmission fluids, is disclosed. The additives comprise an organic phosphite ester such as triphenyl phosphite and a hydroxyl amine compound, such as that having the formula

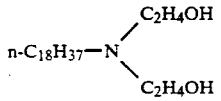

preferably in combination with a dispersant such as a polyisobutenyl succinimide or a borated derivative thereof.

44 Claims, No Drawings

SYNERGISTIC COMBINATION OF ADDITIVES USEFUL IN POWER TRANSMITTING COMPOSITIONS

BACKGROUND OF THE INVENTION

The present invention relates to a synergistic mixture of hydrocarbon soluble or dispersible additives for oleaginous compositions such as lubricating oils, including power transmitting fluids and engine lubricating oils, and to the oleaginous compositions in which they are contained.

There are many instances, as is well known, particularly under boundary lubrication conditions where two moving surfaces in contact with each other must be lubricated, or otherwise protected, so as to prevent wear, and to insure continued movement. There are other instances where friction between two rubbing surfaces is sought to be modified but not necessarily minimized. By controlling friction between two surfaces, the power required to impart movement from one surface to another is also controlled.

For example, a specialized property sought to be imparted to certain lube oil compositions adapted for use as an automatic transmission fluid is the friction modification characteristic of the fluid. This property distinguishes automatic transmission fluids (ATF) from other lubricants, and in fact between types of ATFs as well. Such characteristic quality has received the most attention by both the transmission manufacturers and fluid producers for many years. This attention stems from the fact that the friction requirements of an ATF are unique and depend on the transmission and clutch design, as well as on the type of clutch plate material used.

Another property sought to be imparted to lubricating oil compositions including automatic transmission fluids is reduced wear such as bearing and power component wear.

As is also well known, both wear and friction modification can be controlled through the addition of suitable additives with varying degrees of success.

While there are many known additives which may be classified as anti-wear, or friction modifying agents, it is also known that many of these additives act in a different physical or chemical manner and often compete with one another, e.g. they may compete for the surface of the moving metal parts which are subjected to lubrication. Accordingly, extreme care must be exercised in the selection of these additives to insure compatibility and effectiveness.

The metal dihydrocarbyl dithiophosphates are one of the additives which are known to exhibit anti-oxidant and anti-wear properties. The most commonly used additives of this class are the zinc dialkyl dithiophosphates (ZDDP) which are conventionally used in lubricant compositions. While such zinc compounds afford excellent oxidation resistance and exhibit superior anti-wear properties, they can be corrosive.

Both anti-wear and friction modifying agents function by forming a coating on the surface of the moving metal parts. The coating bonds are generally effected physically and/or chemically. Consequently, if the bonding between the anti-wear agent and the metal part is stronger than the bonding between the friction modifying agent and the metal part, the anti-wear agent will displace the friction modifying agent at the metal surface, i.e. at the metal/fluid lubrication boundary interface. This results in a loss in the ability of the friction modifying agent to exert its intended effect.

Various tests have been designed by auto manufacturers for measuring ATF friction and anti-wear properties to evaluate the performance of additives in view of the requirements of particular transmission designs and their ability to impart transmission durability and smooth shifting under a variety of load conditions.

Friction modification is typically evaluated on an SAE No. 2 friction apparatus. In this test, the motor and flywheel of the friction machine (filled with fluid to be tested) are accelerated to constant speed, the motor is shut off and the flywheel speed is decreased to zero by application of the clutch. The clutch plates are then released, the flywheel is again accelerated to constant speed, and the clutch pack which is immersed in the test fluid is engaged again. This process is repeated many times with each clutch engagement being called a cycle.

During the clutch application, friction torque is recorded as a function of time. The friction data obtained are either the torque traces themselves or friction coefficients calculated from the torque traces. The shape of the torque trace desired is set by the auto manufacturers. One way of expressing this shape mathematically is to determine the torque: (a) when the flywheel speed is midway between the maximum constant speed selected and zero speed (such torque measurement is referred to herein as $T_D$) and (b) when as the flywheel speed approaches zero rpm (such torque measurement is referred to herein as $T_O$). Such torques can then be used to determine the torque ratio which is expressed as $T_O/T_D$, or alternatively, to determine the torque differential $T_O-T_D$. The typical optimum values for torque ratio and torque differential are set by the auto manufacturers. As the $T_O/T_D$ increasingly exceeds 1, a transmission will typically exhibit shorter harsher shifts as it changes gears. On the other hand as $T_O/T_D$ decreases below 1, there is an increasingly greater danger of clutch slippage when the transmission changes gears. Similar relationships exist with respect to a $T_O-T_D$ target value of 0.

While many automatic transmission fluids can achieve target values of $T_O/T_D$ after a minimum number of cycles, it becomes increasingly more difficult to sustain such target values as the number of cycles are increased. The ability of an ATF to sustain such desired friction properties is referred to herein as friction stability or durability A high level of friction stability is difficult to achieve with ATFs containing certain anti-wear additives. It is believed that as the ATF ages under the influence of the heat of friction, the anti-wear agent can break down and the decomposition products displace conventional friction modifiers at the metal/fluid lubrication boundary interface. As a result, the fluid may exhibit varying friction properties.

Attempts to improve friction stability by simply adding more friction modifier have not met with success because this tends to reduce the breakaway static torque ($T_S$) of the fluid. This parameter when expressed as the breakaway static torque ratio ($T_S/T_D$) reflects the relative tendency of engaged parts, such as clutch packs, bands and drums, to slip under load. If this value is too low, the slippage can impair the driveability and safety of the vehicle.

Transmission designs have undergone radical changes, thereby necessitating the formulation of ATF additives capable of meeting new and more stringent property requirements needed to match such design changes.

No base oil alone can even approach the many special properties required for ATF service. Consequently, it is necessary to employ several chemical additives, each of which is designed to impart or improve a specific property of the fluid. Consequently, it becomes particularly advantageous when one additive can perform more than one function, thereby reducing the number of additives needed to be present in the formulation.

Accordingly, there has been a continuing search for new additives possessed of one or more properties which render them suitable for use in ATF compositions, as well as other oleaginous compositions. There also has been a search for new combinations of additives which not only provide ATF compositions, as well as other oleaginous compositions, with the various specific properties that are required, but which are compatible with each other in the sense that they do not exhibit any substantial tendency to compete with each other, nor to otherwise reduce the effectiveness of the various additives in the compositions. The present invention was developed in response to this search.

U.S. Pat. No. 3,034,907 discloses agents which are effective for hindering or retarding rust formation on iron surfaces and ice formation in the intake system of internal combustion engines. The agents which are disclosed are characterized by a content of (a) a hydrophobic organic carrier, (b) a carboxylic acid amide monocarboxylic acid, and (c) an at least equivalent amount of a hydroxyalkylated nitrogen base which contains at least one lipophilic radical. The hydroxyalkylated nitrogen base corresponds to the general formula

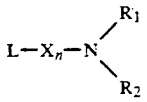

wherein L represents a lipophilic radical; X represents a bridging member which is bound to the nitrogen atom by means of an aliphatic carbon atom and which is selected from lower —O-alkylene, —S-alkylene, —O-hydroxyalkylene, —S-hydroxyalkylene,

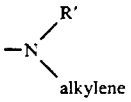

(R'=H, alkyl, hydroxyalkyl), —CO—O-alkylene, and —CO—O-hydroxyalkylene radicals; n represents the integer 0 or 1; $R_1$ represents hydrogen, a lower alkyl or lower hydroxyalkyl or lower aminoalkyl radical; and $R_2$ is the same as ($L\text{-}X_n$) and $R_1$. In one embodiment, L represents an aliphatic $C_{12}$–$C_{18}$ hydrocarbon radical, n is 0, and at least one of $R_1$ and $R_2$ is a low molecular weight hydroxyalkyl or hydroxyalkylaminoethyl radical.

U.S. Pat. No. 3,933,659 discloses lubricating oil position which comprise a major amount of an oil of lubricating viscosity, and an effective amount of each of the following: (1) an alkenyl succinimide, (2) a Group II metal salt of a dihydrocarbyl dithiophosphoric acid, (3) a compound selected from the group consisting of (a) fatty acid esters of dihydric and other polyhydric alcohols, and oil soluble oxyalkylated derivatives therof, (b) fatty acid amides of low molecular weight amino acids, (c) N-fatty alkyl-N,N-diethanol amines, (d) N-fatty alkyl-N,N-di(ethoxyethanol) amines, (e) N-fatty alkyl-N,N-dipoly(ethoxy) ethanol amines, and (f) mixtures thereof, and (4) a basic sulfurized alkaline earth metal alkyl phenate. Such lubricating compositions are useful as functional fluids in systems requiring fluid coupling, hydraulic fluid and/or lubrication of relatively moving parts, particularly as automatic transmission fluids.

U.S. Pat. No. 4,409,000 discloses the use of combinations of certain hydroxy amines, particularly the "Ethomeens", and hydrocarbon-soluble carboxylic dispersants as engine and carburetor detergents for normally liquid fuels.

U.S. Pat. No. 4,231,883 relates to the use of an alkoxylated hydrocarbyl amine in a lubricating oil or fuel to reduce the friction of an internal combustion engine in which the lubricating oil or fuel is used. An example of the alkoxylated hydrocarbyl amine compounds that are disclosed in this patent is N,N-bis(2-hydroxyethyl) oleylamine.

U.S Pat. No. 4,486,324 discloses an aqueous hydraulic fluid comprising at least 80% water and containing a hydrocarbyl-substituted succinic acid, a zinc dihydrocarbyl dithiophosphate, a hydroxyalkylamine, sodium alkyl benzene sulfonate, and optionally, a polyalkylene glycol mono-fatty acid ester.

U.S. Pat. No. 4,129,508 relates to lubricant and fuel compositions characterized by improved demulsifying properties. The patent discloses, for example, at Col. 12, lines 55 ff., an automatic transmission fluid which includes a number of additives including a dialkyl phosphite, the reaction product of a polyisobutenyl-substituted succinic anhydride, commercial tetraethylene pentamine, and boric acid prepared as set forth in U.S. Pat. No. 3,254,025, and a conventional friction modifier based on polyoxyethylene tallow amine (Ethomeen T/12), the reaction product of polyisobutenyl succinic anhydride and an ethylene polyamine, and Ethomeen C/15. The Ethomeen compounds are available commercially from the Armak Chemcial Division of Akzo Chemie.

U.S Pat. No. 2,151,300 relates to lubricating oil compositions which contain a major proportion of a mineral lubricating oil, a minor proportion of an organic phosphite, and a small amount, sufficient to bring about substantial stability of the phosphorous compound, of an oil soluble organic amine.

U.S. Pat. No. 4,634,543 relates to a fluid composition for use in a shock absorber. The fluid composition comprises a lubricating base oil, a boron-containing compound, and a dialkyl- or diaryl acid phosphate and/or a dialkyl- or diaryl hydrogen phosphite.

U.S. Pat. No. 3,645,886 relates to the concept of reducing or preventing the fouling of process equipment in petroleum or chemical industries wherein an organic feed stock is subjected to heat exchange at a temperature of from about 200° to about 1300° F., and there is added to that organic feed stock a mixture of a fatty acid ester of an alkanol amine and a mono-, di-, or triorganic phosphite ester.

U.S. Pat. No. 3,484,375 relates to the production of additives for lubricating oils, middle distillate fuels, residual fuels or reduced crudes in order to improve their resistance to oxidation, sludge formation, to improve their viscosity index, or to improve their flowability and pour point characteristics. The additives are prepared by reacting an organic phosphite ester containing at least one hydroxyl group attached to the phosphorous with alkaline polyamines or aminoalcohols.

U.S. Pat. No. 4,170,560 discloses additive compositions for use in crank case lubricating oils comprising a mixture of an oil soluble anti-oxidant and a oil soluble hydroxylamine which includes both Ethomeens and Ethoduomeens, which are trade names for compounds available commercially from the Armak Chemical Division of Akzo Chemie.

U S. Pat. No. 4,382,006 discloses a lubricating composition containing a friction reducing portion of a borated adduct of compounds which include Ethomeens.

U.S. Pat. No. 2,917,160 discloses the use of certain hydroxylated tertiary amines which include Ethomeen, as a corrosion inhibiting surface active lubricant for metal working. The amines may be used in the form of a salt. Phosphoric acid salts are illustrated.

U.S. Pat. No. 3,186,946 discloses cutting fluids in which the active lubricating component is a borate salt of a tertiary amine which includes both Ethomeen and Ethoduomeens.

U.S. Pat. No. 3,509,052 relates to lubricating compositions containing a lubricating oil, a dispersant which is a derivative of a substituted succinic acid, and a demulsifier. The demulsifier may comprise, for example, an Ethomeen, but the preferred demulsifiers are polyoxyalkylene polyols and derivatives thereof.

U.S. Pat. No. 3,502,677 relates to substituted polyamines which are useful as additives in lubricating compositions, fuels, hydrocarbon oils and power-transmitting fluids. The substituted polyamines are prepared by reacting an alkylene polyamine with a substantially hydrocarbon-substituted succinic acid-producing compound and a phosphorous acid-producing compound. The patent discloses the use of other additives in combination with the substituted polyamines wherein the other additives include phosphorous esters such as dihydrocarbon and trihydrocarbon phosphites. Other nitrogen- and phosphorous-containing succinic derivatives are disclosed in U.S. Pat. No. 3,513,093. The products disclosed in that patent are also useful as additives in lubricating oils, fuels, plastics, etc.

U.S. Pat. No. 4,557,845 discloses that the products of reaction between a 2-hydroxethyl alkylamine or certain higher oxylated members, and a dihydrocarbyl phosphite compound are effective friction modifiers and fuel reducing additives for internal combustion engines when such products are compounded with lubricants and liquid fuels. A similar disclosure is contained in U.S. Pat. No. 4,529,528, except that the products are prepared by reacting a bis(2-hydroxyethyl) alkylamine, a dihydrocarbyl phosphite and a boron compound.

U S Pat. No. 4,681,694 relates to a crankcase lubricating oil composition for slow speed diesel engines. The composition contains a mineral lubricating oil, an overbased calcium alkylphenolate, a zinc dihydrocarbyl dithiophosphate, an alkylated diphenylamine, and a rust-inhibiting amount of at least one dialkoxylated alkylpolyoxyalkyl primary amine.

U.S. Pat. No. 4,704,217 discloses a gasoline crankcase lubricant which contains a friction modifier having the formula:

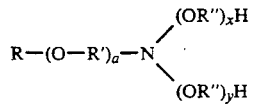

wherein R is a $C_1$–$C_{20}$ hydrocarbyl radical, R′ and R″ are divalent $C_1$–$C_{10}$ alkylene groups, a is an integer of about 1 to about 10 and x+y has a value of about 1 to 20.

SUMMARY OF THE INVENTION

The present invention is based in part on the discovery that a synergestic combination of compounds possess multifunctional properties including those of oxidation inhibition, anti-wear and friction modification. In addition, the individual compounds comprising such combination are compatible with each other, are stable, and hence do not necessarily adversely affect friction stability of automatic transmission fluids. In short, the combination of the individual compounds is considered to be a desirable combination of additives for use in power transmission fluids, and more particularly automatic transmission fluids, which in the past have used combinations of additives including ZDDP.

In one aspect of the present invention, an organic phosphite ester having the formula:

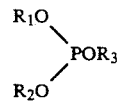

I wherein $R_1$, $R_2$ and $R_3$, independently, represent the same or different aryl or alkyl-substituted aryl hydrocarbyl radical having from about 6 to about 30 carbon atoms is employed in a lubricating oil composition as part of a 2-component combination of additives which further includes a hydroxyl amine compound friction modifier.

The hydroxyl amine compound is characterized by one of the following Formulas II or III:

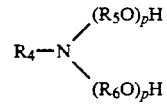

II wherein $R_4$ represents a $C_7$-$C_{28}$ saturated or unsaturated aliphatic hydrocarbon radical; $R_5$ and $R_6$ represent the same or different straight or branched chain $C_2$–$C_6$ alkylene radical; and p, independently, represents 1–4; and wherein it is preferred that there are a total of from about 18 to about 30 carbon atoms in the compound; or

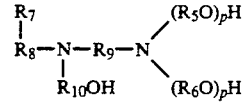

III wherein $R_5$, $R_6$ and p are the same as for Formula II above, wherein $R_7$ represents H or $CH_3$; $R_8$ represents a $C_7$–$C_{27}$ straight or branched chain alkylene radical; $R_9$ represents a straight or branched chain $C_1$–$C_5$ alkylene radical; and $R_{10}$ represents a straight or branched chain $C_1$–$C_5$ alkylene radical, and wherein it is preferred that there are a total of from about 18 to about 30 carbon atoms in the compound.

In a further aspect of the invention, the lubricating oil compositions are adaptable for use as power transmitting fluids, particularly automatic transmission fluids, which comprise, in addition to the herein described 2-component additive combination, a dispersant, a seal swell additive, an anti-oxidant, a viscosity index improver, and a base oil.

The above combination of additives is particularly suited to meeting the stringent ATF requirements from the standpoint of the proper balance of anti-wear, static and dynamic friction coefficients, friction modification and stability, dispersancy, sludge inhibition, anti-oxidation and corrosion resistance properties.

In another aspect of the invention, the above-described organic phosphites may be employed in combination with the reaction product of the hydroxyl amine compound with a boron compound such as boric acid or a $C_1$–$C_4$ trialkyl borate.

In another aspect of the present invention, there is provided a lubricating oil composition adaptable for use as a power transmitting fluid comprising the above-described 2-component combination of additives.

In a still further embodiment of the present invention, there is provided a lubricating oil composition concentrate adaptable for use as an automatic transmission fluid comprising the above-described 2-component combination of additives.

In another embodiment of the present invention, there is provided a lubricating oil composition concentrate adaptable for use as a power transmitting fluid which comprises a lubricating oil having dissolved or dispersed therein at least one of the herein described organic phosphite compounds and at least one of the herein described hydroxyl amine compounds, preferably in combination with at least one additional additive selected from dispersants, seal swellants, anti-oxidants, and viscosity index improvers.

In another embodiment of the present invention there is provided a process for improving the oxidation inhibition, anti-wear and friction modification properties of a lubricating oil composition which is adapted for use as a power transmitting fluid which comprises adding to said lubricating oil composition at least one of the organic phosphite compounds and at least one of the hydroxyl amine compounds disclosed herein.

DESCRIPTION OF PREFERRED EMBODIMENTS

The organic phosphite ester additives of the present invention can be represented by the structural formula:

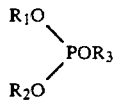

I where $R_1$, $R_2$ and $R_3$, which may be the same or different, independently can represent an aryl radical or an alkyl-substituted aryl radical (preferably phenyl or $C_3$–$C_6$ alkyl-substituted phenyl), typically about $C_6$ to about $C_{30}$, preferably about $C_6$ to about $C_{18}$, and most preferably about $C_6$ to about $C_{10}$ aryl or alkyl-substituted aryl radical.

Representative examples of suitable $R_1$, $R_2$ and $R_3$ groups of Formula I include phenyl, p-methylphenyl, o-methylphenyl, p-propylphenyl, o-ethylphenyl, p-butylphenyl, o-butylphenyl, p-hexylphenyl, p-isononylphenyl, p-2-ethylhexylphenyl, o-t-octylphenyl and the like.

The more preferred $R_1$, $R_2$ and $R_3$ groups include phenyl, p-methylphenyl, o-methylphenyl, p-ethylphenyl, o-ethylphenyl, p-n-propylphenyl, p-isopropylphenyl, o-n-propylphenyl, p-n-butylphenyl, p-isobutylphenyl, o-n-butylphenyl and o-isobutylphenyl. In most cases it is preferred that $R_1$, $R_2$ and $R_3$ are the same for any given organic phosphite ester. The most preferred phosphite is triphenyl phosphite. The organic phosphites can be obtained by the direct esterification of phosphorous acid or a phosphorous trihalide with phenol or an alkyl-substituted phenol or a mixture thereof. The reaction is usually carried out simply by mixing the reactants at a temperature above 50° C., preferably between 80° and 150° C., in the presence or absence of a solvent. Suitable solvents which may be used include, for example, benzene, naphtha, chlorobenzene, mineral oil, kerosene, cyclohexane, or carbon tetrachloride. A solvent capable of forming a relatively low boiling azeotrope with water further aids the removal of water in the esterification of phenol or alkyl-substituted phenol with the phosphorus acid reactant. The relative amounts of the phenol reactant and the acid reactant influence the nature of the ester obtained. For instance, equimolar amounts of a phenol and phosphorus acid tend to result in the formation of a monoester of phosphorus acid, whereas the use of a molar excess of the phenol reactant in the reaction mixture tends to increase the proportion of the diester or triester in the product. Accordingly, since the triester is the desired product contemplated for use in the present invention, relatively large molar excess of the phenol reactant to the phosphorous acid reactant should be used. Typically, a mole ratio of the phenol reactant to the phosphorous acid reactant of from about 12:1 to about 4:1, preferably from about 8:1 to 6:1, and most preferably 7:1 to 5:1 would be used. The methods for preparing the organic phosphite esters are known in the art and are discussed, for example, in U.S. Pat. No.3,513,093, the disclosure of which is incorporated herein by reference.

The hydroxyl amine compounds contemplated for use in this invention are characterized by one of the following Formulas II and III:

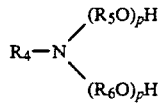

II

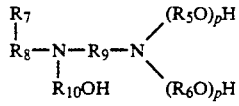

III where $R_4$ represents a straight or branched chain, saturated or unsaturated, aliphatic hydrocarbon radical (preferably straight chain alkylene), typically about $C_7$ to about $C_{28}$, preferably about $C_{10}$ to about $C_{20}$, and most preferably about $C_{12}$ to $C_{18}$ alkylene; $R_5$ and $R_6$, independently, represent a straight or branched chain alkylene radical (preferably straight alkylene), typically $C_2$ to about $C_6$, preferably about $C_2$ to about $C_4$, and most preferably $C_2$ alkylene; $R_7$ represents H or $CH_3$, preferably H; $R_8$ represents a straight or branched chain, saturated or unsaturated, aliphatic hydrocarbon radical (preferably straight chain alkylene), typically about $C_7$ to about $C_{28}$, preferably about $C_{10}$ to about $C_{20}$, and most preferably about $C_{12}$ to about $C_{18}$ alkylene; $R_9$ and $R_{10}$, independently, represent a straight or branched chain $C_1$–$C_5$ alkylene radical (preferably $C_2$–$C_4$ alkylene); and p, independently, is 1–4, preferably 1–3 (e.g., 1). In a particularly preferred embodiment, the hydroxyl amine would be characterized by the Formula II wherein $R_4$ represents $C_{18}$ alkylene, $R_5$ and $R_6$ each represent $C_2$ alkylene, and p is 1. In all cases, it is preferred that the hydroxyl amine compounds contain a combined total of from about 18 to about 30 carbon atoms.

The present hydroxyl amine friction modifiers are well known in the art and are described, for example, in U.S. Pat. Nos. 3,186,946, 4,170,560, 4,231,883, 4,409,000 and 3,711,406, the disclosures of these patents being incorporated herein by reference. The hydroxyl amines having the Formula II may be prepared by reacting from about one to six moles of ethylene oxide with one mole of the corresponding primary amine, whereas the hydroxyl amines of Formulas III may be prepared by reacting one to six moles of ethylene oxide with the corresponding amine having both primary and secondary amine functionality. The starting material from which these amines are commonly prepared is usually a mixture of fatty acids rather than a pure fatty acid, and the amines therefore usually are available as mixtures of amines having carbon chains of varying lengths. For example, the amines are commonly prepared from mixed coconut oil fatty acids, mixed soya fatty acids or mixed tallow fatty acids. Coconut oil fatty acids consist primarily of fatty acids having twelve carbon atoms and contain minor proportions of fatty acids having eight or ten carbon atoms, as well as fatty acids having more than twelve carbon atoms. On the other hand, tallow fatty acids and soya fatty acids consist primarily of fatty acids having eighteen carbon atoms, with a small proportion of fatty acids having sixteen carbon atoms. The proportion of fatty acids having eighteen carbon atoms is most predominant in soya fatty acids, and tallow fatty acids ordinarily contain a small percentage of fatty acids having fourteen carbon atoms. Amines derived from soya fatty acids and tallow fatty acids are preferred for use as starting materials in the practice of the present invention, because the average length of the carbon chains which they contain is greater than in amines derived from coconut oil fatty acids.

The addition of ethoxy groups, for example in preparing a hydroxyl amine having the general Formula II from corresponding amine, tends to increase the solubility, to some extent at the expense of other properties of the amine. Thus, the preferred hydroxyl amines having the general Formulas II or III for use in the practice of the invention, are hydroxyl amines having from one to three ethoxy groups. Such hydroxyl amine compounds are available commercially, from the Armak Chemical Division of Akzo Chemie, for example, under the trade names Ethomeen, Ethomeen T/12, Ethomeen C/15, Ethoduomeen T/12, Ethoduomeen T/15, etc.

Representative examples of suitable compounds falling within the scope of the above structural Formulas II and III are provided in Tables 1 and 2 in chart form wherein each of the variable groups are associated in specific compounds.

TABLE 1

FORMULA: $R_4-N\begin{matrix}(R_5O)_pH\\(R_6O)_pH\end{matrix}$ II

| $R_4$ | $R_5$ | $R_6$ | p |
|---|---|---|---|
| $C_8H_{17}$— | —$C_4H_8$— | —$C_3H_6$— | 2 |
| $C_9H_{19}$— | —$C_2H_4$— | —$C_4H_8$— | 3 |
| $C_{10}H_{21}$— | —$C_2H_4$— | —$C_5H_{10}$— | 4 |
| $C_{11}H_{23}$— | —$C_3H_6$— | —$C_2H_4$— | 3 |
| $C_{12}H_{25}$— | —$C_6H_{12}$— | —$C_2H_4$— | 2 |
| $C_{14}H_{29}$— | —$C_3H_6$— | —$C_2H_4$— | 2 |
| $C_{16}H_{33}$— | —$C_3H_6$— | —$C_2H_4$— | 2 |
| $C_{17}H_{35}$— | —$C_3H_6$— | —$C_2H_4$— | 2 |
| $C_{18}H_{37}$— | —$C_3H_6$— | —$C_2H_4$— | 1 |
| $C_{18}H_{37}$— | —$C_2H_4$— | —$C_2H_4$— | 2 |
| $C_{18}H_{37}$— | —$C_4H_8$— | —$C_4H_8$— | 2 |
| $C_{18}H_{37}$— | —$C_2H_4$— | —$C_4H_8$— | 1 |
| $C_{20}H_{41}$— | —$C_2H_4$— | —$C_3H_6$— | 2 |
| $C_{22}H_{43}$— | —$C_3H_6$— | —$C_2H_4$— | 1 |
| $C_{25}H_{51}$— | —$C_3H_6$— | —$C_2H_4$— | 2 |
| $C_{18}H_{37}$— | —$C_5H_{10}$— | —$C_2H_4$— | 1 |
| $C_{28}H_{59}$— | —$C_3H_6$— | —$C_2H_4$— | 1 |
| $C_{14}H_{29}$— | —$C_2H_4$— | —$C_2H_4$— | 1 |

TABLE 2

FORMULA: $R_8-\underset{\underset{R_{10}OH}{|}}{\overset{\overset{R_7}{|}}{N}}-R_9-N\begin{matrix}(R_5O)_pH\\(R_6O)_pH\end{matrix}$ III

| $R_7$ | $R_8$ | $R_9$ | $R_{10}$ | $R_5$ | $R_6$ | P |
|---|---|---|---|---|---|---|
| H— | —$C_7H_{14}$— | —$CH_2$— | —$C_2H_4$— | —$C_2H_4$— | —$C_2H_4$— | 1 |
| H— | —$C_8H_{16}$— | —$C_2H_4$— | —$C_3H_6$— | —$C_2H_4$— | —$C_3H_6$— | 2 |
| H— | —$C_{12}H_{24}$— | —$C_3H_6$— | —$C_4H_8$— | —$C_3H_6$— | —$CH_2$— | 3 |
| H— | —$C_{16}H_{32}$— | —$C_5H_{10}$— | —$C_5H_{10}$— | —$C_2H_4$— | —$C_3H_6$— | 1 |
| H— | —$C_{18}H_{36}$— | —$C_3H_6$— | —$C_2H_4$— | —$C_2H_4$— | —$C_2H_4$— | 1 |
| $CH_3$— | —$C_{17}H_{34}$— | —$C_4H_8$— | —$C_3H_6$— | —$C_2H_4$— | —$C_2H_4$— | 1 |
| $CH_3$— | —$C_{20}H_{40}$— | —$C_2H_4$— | —$CH_2$— | —$C_2H_4$— | —$C_2H_4$— | 1 |
| H— | —$C_{27}H_{54}$— | —$CH_2$— | —$CH_2$— | —$C_2H_4$— | —$C_2H_4$— | 1 |
| $CH_3$— | —$C_{10}H_{20}$— | —$C_3H_6$— | —$C_2H_4$— | —$C_2H_4$— | —$C_2H_4$— | 2 |

The hydroxyl amine compounds may be used as such. However they may also be used in the form of an adduct or reaction product with a boron compound, such as a boric oxide, a boron halide, a metaborate, boric acid, or a mon-, di-, and trialkyl borate. Such adducts or derivatives may be illustrated, for example, following structural formula:

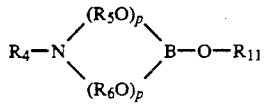

IV wherein $R_4$, $R_5$, $R_6$, and p are the same as defined above, and wherein $R_{11}$ is either H or an alkyl radical.

Representative examples of alkyl borates which may be used to borate the hydroxyl amine compounds include mono-, di-, and tributyl borates, mono-, di-, and trihexyl borates, and the like. The borated adducts may be prepared simply by heating a mixture of the hydroxyl amine compound and the boron compound, preferably in the presence of a suitable solvent or solvents, preferably a hydrocarbon solvent. The presence of a solvent is not essential, however, if one is used it may be reactive or non-reactive. Suitable non-reactive solvents include benzene, toluene, xylene and the like. Reaction temperatures suitably may be on the order of about 100° to about 200° C., preferably from about 125° to 175° C. Reaction time is not critical and, depending on the temperature, etc., it may vary from about 1-2 hours up to about 15 hours, e.g. 2 to 6 hours until the desired amount of water is removed. Such boration procedures are well known in the art and are described, for example, in U.S. Pat. Nos. 4,529,528, 4,594,171, and 4,382,006, the disclosures of which are incorporated herein by reference.

The combination of the organic phosphite esters and the hydroxyl amine compounds of the present invention has been found to impart multifunctional properties to lubricating oil compositions in which the combination is added, including anti-wear, friction modification, oxidation inhibition, and copper corrosion resistance properties.

Accordingly, the additive combination of the invention is used by incorporation and dissolution or dispersion into an oleaginous material such as fuels and lubricating oils.

The present combination of additives finds its primary utility in lubricating oil compositions which employ a base oil in which the additives are dissolved or dispersed.

Such base oils may be natural or synthetic although the natural base oils will derive a greater benefit.

Thus, base oils suitable for use in preparing lubricating compositions of the present invention include those conventionally employed as crankcase lubricating oils for spark-ignited and compression-ignited internal combustion engines, such as automobile and truck engines, marine and railroad diesel engines, and the like. Particularly advantageous results are achieved by employing the additive combination of the present invention in base oils conventionally employed in power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additive combination of the present invention may be suitably incorporated into synthetic base oils such as alkyl esters of dicarboxylic acids, polyglycols and alcohols; poly-alpha-olefins, alkyl benzenes, organic esters of phosphoric acids, polysilicone oil, etc.

Natural base oils include mineral lubricating oils which may vary widely as to their crude source, e.g. whether paraffinic, naphthenic, mixed paraffinic-naphthenic, and the like; as well as to their formation, e.g. distillation range, straight run or cracked, hydrofined, solvent extracted and the like.

More specifically, the natural lubricating oil based stocks which can be used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents such as phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 3.5 to about 9 cst. at 100° C.

Thus the additive combination of the present invention can be employed in a lubricating oil composition which comprises lubricating oil, typically in a major amount, and the additive combination, typically in a minor amount, which is effective to impart enhanced friction modification, anti-wear, friction stability, and sludge inhibition properties relative to the absence of the additives. Additional conventional additives selected to meet the particular requirements of a selected type of lubricating oil composition can be included as desired.

The additive materials of this invention are oil soluble, dissolvable in oil with the aid of a suitable solvent, or are stably dispersible in oil. Oil soluble, dissolvable, or stably dispersible, as that terminology is used herein, does not necessarily indicate that the materials are soluble, dissolvable, miscible, or capable of being suspended in oil in all proportions. It does mean, however, that the respective additives are soluble or stably dispersible in oil to an extent sufficient to exert their intended effect in the environment in which the oil is employed. Moreover, the incorporation of a dispersant and/or other additives may also permit incorporation of higher levels of a particular organic phosphite ester or hydroxyl amine compound, if desired.

The additives of the present invention can be incorporated into the lubricating oil in any convenient way. Thus, they can be added directly to the oil by dispersing, or dissolving the same in the oil at the desired level of concentration typically with the aid of the suitable solvent such as mineral oil. Such blending can occur at room temperature or elevated temperatures. Alternatively, the organic phosphite ester and hydroxyl amine additive combination may be blended with a suitable oil soluble solvent and base oil to form a concentrate, followed by blending the concentrate with lubricating oil base stock to obtain the final formulation.

The lubricating oil base stock for the additives of the present invention typically is adapted to perform a selected function by the incorporation of additives therein to form lubricating oil compositions (i.e., formulations).

As indicated above, one broad class of lubricating oil compositions suitable for use in conjunction with the additives of the present invention are power steering fluids, tractor fluids, tractor universal oils, and the like.

The benefits of the additives of the present invention are particularly significant when employed in a lubricating oil adapted for use as an automatic transmission fluid.

Power transmitting fluids, such as automatic transmission fluids, as well as lubricating oils in general, are typically compounded from a number of additives each useful for improving chemical and/or physical properties of the same. The additives are usually sold as a concentrate package in which mineral oil or some other base oil is present. The mineral lubricating oil in automatic transmission fluids typically is refined hydrocarbon oil or a mixture of refined hydrocarbon oils selected according to the viscosity requirements of the particular fluid, but typically would have a viscosity range of 2.5–9, e.g. 3.5–9 cst. at 100° C. Suitable base oils include a wide variety of light hydrocarbon mineral oils, such as naphthenic base oils, paraffin base oils, and mixtures thereof.

Representative additives which can be present in such packages as well as in the final formulation include viscosity index (V.I.) improvers, corrosion inhibitors, oxidation inhibitors, friction modifiers, lube oil flow improvers, dispersants, anti-foamants, anti-wear agents, detergents, metal rust inhibitors and seal swellants.

Viscosity modifiers impart high and low temperature operability to the lubricating oil and permit it to remain shear stable at elevated temperatures and also exhibit acceptable viscosity or fluidity at low temperatures.

V.I. improvers are generally high molecular weight hydrocarbon polymers or more preferably polyesters. The V.I. improvers may also be derivatized to include other properties or functions, such as the addition of dispersancy properties.

These oil soluble V.I. polymers will generally have number average molecular weights of from $10^3$ to $10^6$, preferably $10^4$ to $10^6$, e.g. 20,000 to 250, determined by gel permeation chromatography or membrane osmometry.

Examples of suitable hydrocarbon polymers include homopolymers and copolymers of two or more monomers of $C_2$ to $C_{30}$, e.g. $C_2$ to $C_8$ olefins, including both alphaolefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alphaolefins, atactic polypropylene, hydrogenated polymers and copolymers and terpolymers of styrene, e.g. with isoprene and/or butadiene.

More specifically, other hydrocarbon polymers suitable as viscosity index improvers in the present invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, alpha-olefins or lower alkenes, e.g., $C_3$ to $C_{18}$ alpha-olefins or lower alkenes. The conjugated dienes include isoprene, butadiene, 2,3-dimethylbutadiene, piperylene and/or mixtures thereof, such as isoprene and butadiene. The monovinyl aromatic compounds include vinyl di- or polyaromatic compounds, e.g., vinyl naphthalene, or mixtures of vinyl mono-, di- and/or polyaromatic compounds, but are preferably monovinyl monoaromatic compounds, such as styrene or alkylated styrenes substituted at the alpha-carbon atoms of the styrene, such as alpha-mehtylstyrene, or at ring carbons, such as o-, m-, p-methylstyrene, ethylstyrene, propylstyrene, isopropylstyrene, butylstyrene isobutylstyrene, tert-butylstyrene (e.g., p-tert-butylstyrene). Also included are vinylxylenes, methylethylstyrenes and ethylvinylstyrenes. Alphaolefins and lower alkenes optionally included in these random, tapered and block copolymers preferably include ethylene, propylene, butene, ethylene-propylene copolymers, isobutylene, and polymers and copolymers thereof. As is also known in the art, these random, tapered and block copolymers may include relatively small amounts, that is less than about 5 mole %, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to said nucleus, the arms being comprised of homopolymer or interpolymer of said conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621, 3,318,813, 3,630,905, 3,668,125, 3,763,044, 3,795,615, 3,835,053, 3,838,049, 3,965,019, 4,358,565, and 4,557,849, the disclosures of which are herein incorporated by reference.

The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794, 4,160,739, 4,137,185, or copolymers of ethylene and propylene reacted or grafted with nitrogen compounds such as shown in U.S. Pat. Nos. 4,068,056, 4,068,058, 4,146,489 and 4,149,984.

Suitable hydrocarbon polymers are ethylene copolymers containing from 15 to 90 wt % ethylene, preferably 30 to 80 wt. % of ethylene and 10 to 85 wt. % preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methyl-heptene-1, etc., and mixtures thereof.

Terpolymers, tetrapolymers, etc., of ethylene, said $C_{3-28}$ alpha-olefin, and non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The preferred V.I. improvers, are polyesters, most preferably polyesters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g. see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers to impart dispersancy include those containing 4 to 20 carbon atoms such as amino substituted olefins as p-(betadiethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinylpyridine, 4-methyl-2-vinyl-pyridine, 4-ethyl-2-vinylpyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methyl-vinyl) pyrrolidone, N-vinyl-5-methyl pyrrolidone, N-vinyl-3,3-dimethylpyrrolidone, N-vinyl-5-ethyl pyrrolidone, etc.

Corrosion inhibitors, also known as anticorrosive agents, reduce the degradation of the non-ferrous metallic parts in contact with the fluid. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioether, and also preferably in the presence of carbon dioxide. The phosphosulfurized hydrocarbons may be prepared by reaction of a sulfide of phosphorus such as $P_2S_3$, $P_2S_5$, $P_4S_7$, $P_4S_{10}$, preferably $P_2S_5$, with a suitable hydrocarbon material such as a heavy petroleum fraction, a polyolefin, or a terpene or mixtures thereof.

The heavy petroleum fractions that may be employed include distillates or residua containing less than 5% of aromatics and having viscosities at 210° F. in the range of about 140 to 250 SUS.

The terpenes which may be used are unsaturated hydrcarbons hving the formula $C_{10}H_{16}$, occuring in most essential oils and oleoresins of plants. The terpenes are based on the isoprene unit $C_5H_8$, and may be either acyclic or cyclic with one or more benzenoid groups. They are classified as monocyclic (dipentene), dicyclic (pinene), or acyclic (myrcene), according to the molecular structure. The preferred terpenes are bicyclic such as alpha-pinene and beta-pinene.

Suitable polyolefins include those having Staudinger molecular weights in the range of typically from about 500 to about 200,000, preferably from about 600 to about 20,000, and most preferably from about 800 to about 2,000, and containing from 2 to 6 carbon atoms per olefin monomer, e.g., ethylene, propylene, butylene, isobutylene, isoamylene and mixtures. Particularly preferred polyolefins are the polyisobutylenes having Staudinger molecular weights in the range of from about 700 to about 100,000.

The phosphosulfurized hydrocarbon can be prepared by reacting the hydrocarbon with from about 5 to 30 wt. percent of a sulfide of phosphorus, preferably with from about 10 to 20 wt. percent of phosphorous pentasulfide under anhydrous conditions at temperatures of from about 150° to about 400° F. for from about one-half to about 15 hours. The preparation of the phosphosulfurized hydrocarbons is well known in the art and is described, for example, in U.S. Pat. Nos. 2,875,188, 3,511,780, 2,316,078, 2,805,217 and 3,850,822, the disclosures of which are incorporated herein by reference. Neutralization of the phosphosulfurized hydrocarbon may be effected in the manner taught in U.S. Pat. No. 2,969,324.

Other suitable corrosion inhibitors include copper corrosion inhibitors comprising hydrocarbylthio-disubstitutued derivatives of 1, 3, 4-thiadiazole, e.g., $C_2$ to $C_{30}$; alkyl, aryl, cycloalkyl, aralkyl and alkaryl-mono-, di-, tri-, or tetra- or thiodisubstituted derivatives thereof.

Representative examples of such materials included 2,5-bis(octylthio)-1,3,4-thiadiazole; 2,5-bis(octyldithio)-1,3,4-thiadiazole; 2,5-bis(octyltrithio)-1,3,4-thiadiazole; 2,5-bis(octyltetrathio)-1,3,4-thiadiazole; 2,5-bis(nonylthio)-1,3,4-thiadiazole; 2,5-bis(dodecyldithio)-1,3,4-thiadiazole; 2-dodecyldithio-5-phenyldithio-1,3,4-thiadiazole; 2,5-bis(cyclohexyl dithio)-1,3,4-thiadiazole; and mixtures thereof.

Preferred copper corrosion inhibitors are the derivatives of 1,3,4-thiadiazoles such as those described in U.S. Pat. Nos. 2,719,125, 2,719,126, and 3,087,932; especially preferred is the compound 2,5-bis(t-octyldithio)-1,3,4-thiadiazole commercially available as Amoco 150, and 2, 5-bis(t-nonyldithio)-1,3,4-thiadiazole, commerically available as Amoco 158.

The preparation of such materials is further described in U.S. Pat. Nos. 2,719,125, 2,719,126, 3,087,932, and 4,410,436, the disclosures of which are hereby incorporated by reference.

Oxidation inhibitors reduce the tendency of mineral oils to deteriorate in service which deterioration is evidenced by the products of oxidation such as sludge and varnish-like deposits on the metal surfaces and by an increase in viscosity. Such oxidation inhibitors include alkaline earth metal salts of alkylphenol thioethers having preferably $C_5$ to $C_{12}$ alkyl side chains, e.g. calcium nonylphenol sulfide, barium t-octylphenol sulfide; aryl amines, e.g. dioctylphenylamine, phenyl-alpha-naphthylamine; phosphosulfurized or sulfurized hydrocarbons; etc.

Friction modifiers serve to impart the proper friction characteristics to an ATF as required by the automotive industry. In the present invention, the hydroxyl amine compounds function as the primary friction modifier. However, the organic phosphite esters impart friction modification as well as anti-wear properties.

Dispersants maintain oil insolubles, resulting from oxidation during use, in suspension in the fluid thus preventing sludge flocculation and precipitation. Suitable dispersants include, for example, dispersants of the ash-producing or ashless type, the latter type being preferred.

The ash-producing detergents are exemplified by oil soluble neutral and basic salts of alkali or alkaline earth metals with sulfonic acids, carboyxlic acids, or organic phosphorus acids characterized by at least one direct carbon-to-phosphorus linkage such as those prepared by the treatment of an olefin polymer (e.g. polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commmonly used salts of such acids are those of sodium, potassium, lithium, calcium, magnesium, strontium and barium.

The term "basic salt" is used to designate metal salts wherein the metal is present in stoichimetrically larger amouts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, ethylene glycol, stearyl alcohol, and cyclohexyl alcohol; and amines such as aniline, phenylenediamine, phenyl-beta-naphthylamine, and dodecylamine. A particularly effective method for preparing the basic salts comprises mixing an acid with an excess of a basic alkaline earth metal neutralizing agent and a least one alcohol promoter, and carbonating the mixture at an elevated temperature such as 60°-200° C.

The most preferred ash-producing detergents include the metal salts of sulfonic acids, alkyl phenols, sulfurized alkyl phenols, alkyl salicylates, naphthenates and other oil soluble mono- and dicarboxylic acids. Highly basic (viz, overbased) metal salts, such as highly basic alkaline earth metal sulfonates (especially Ca and Mg salts) are frequently used as detergents. They are usually produced by heating a mixture comprising an oil soluble sulfonate or alkaryl sulfonic acid, with an excess of alkaline earth metal compound above that required for complete neutralization of any sulfonic acid present, and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as for example haloparaffins, olefins that may be obtained by dehydrogenation of paraffins, polyolefins as for example polymers from ethylene, propylene, etc. The alkaryl sulfonates usually contain from about 9 to about 70 more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to about 220%, although it is preferred to use at least 125%, of the stoichiometric amount of metal required for complete neutralization.

Various other preparations of basic alkaline earth metal alkaryl sulfonates are known, such as those described in U.S. Pat. Nos. 3,150,088 and 3,150,089, wherein overbasing is accomplished by hydrolysis of an alkoxide-carbonate complex with the alkaryl sulfonate in a hydrocarbon solvent/diluent oil.

Ashless dispersants, which are the preferred dispersant for use in connection with this invention, are so called despite the fact that, depending on their constitution, the dispersant may upon combustion yield a nonvolatile material such as boric oxide or phosphorus pentoxide; however, they ordinarily do not contain metal and therefore do not yield a metal-containing ash on combustion. Many types of ashless dispersants are known in the art, and any of them are suitable for usein the lubricant compositions of this invention. The following are illustrative:

1. Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described, for example, in British Pat. Nos. 1,306,529, 3,272,746 3,341,542, 3,454,607 and 4,654,403.

More, specifically, nitrogen- or ester-containing ashless dispersants comprise members selected from the group consisting of oil soluble salts, amides, imides, oxazolines and esters, or mixtures thereof, of long chain hydrocarbyl-substituted mono- and dicarboxylic acids or anhydride or ester derivatives thereof wherein said long chain hydrocarbyl group is a polymer, typically of a $C_2$ to $C_{10}$, e.g., $C_2$ to $C_5$, monoolefin, said polymer having a number average molecular weight of from about 700 to 5000.

The long chain hydrocarbyl-substituted dicarboxylic acid material which can be used to make the dispersant includes the reaction product of long chain hydrocarbon polymer, generally a polyolefin, with (i) monounsaturated $C_4$ to $C_{10}$ dicarboxylic acid wherein (a) the carboxyl groups are vicinyl, (i.e. located on adjacent carbon atoms) and (b) at least one, preferably both, of said adjacent carbon atoms are part of said mono unsaturation; or with (ii) derivatives of (i) such as anhydrides or $C_1$ to $C_5$ alcohol derived mono- or diesters of (i). Upon reaction with the hydrocarbon polymer, the monounsaturation of the dicarboxylic acid material becomes saturated. Thus, for example, maleic anhydride becomes a hydrocarbyl-substituted succinic anhydride.

Typically, from about 0.7 to about 4.0 (e.g., 0.8 to 2.6), preferably from about 1.0 to about 2.0, and most preferably from about 1.1 to about 1.7 moles of said unsaturated $C_4$ to $C_{10}$ dicarboxylic acid material are charged to the reactor per mole of polyolefin charged.

Normally, not all of the polyolefin reacts with the unsaturated acid or derivative and the hydrocarbyl-substituted dicarboxylic acid material will contain unreacted polyolefin. The unreacted polyolefin is typically not removed from the reaction mixture (because such removal is difficult and would be commercially infeasible) and the product mixture, stripped of any unreacted monounsaturated $C_4$ to $C_{10}$ dicarboxylic acid material, is employed for further reaction with the amine or alcohol as described hereinafter to make the dispersant.

Characterization of the average number of moles of dicarboxylic acid, anydride or ester which have reacted per mole of polyolefin charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged using techniques well known in the art. Functionality is defined solely with reference to the resulting product mixture. Consequently, although the amount of said reacted polyolefin contained in the resulting product mixture can be subsequently modified, i.e., increased or decreased by techniques known in the art, such mocdifications do not alter functionality as defined above. The term hydrocarbyl-substituted dicarboxylic acid material is intended to refer to the product mixture whether it has undergone such modification or not.

Accordingly, the functionality of the hydrocarbyl-substituted dicarboxylic acid material will be typically at least about 0.5, preferably at least about 0.8, and most preferably at least about 0.9, and can vary typically from about 0.5 to about 2.8 (e.g., 0.6 to 2), preferably from about 0.8 to about 1.4, and most preferably from about 0.9 to about 1.3.

Exemplary of such unsaturated mono and dicarboxylic acids, or anhydrides and esters thereof are fumaric acid, itaconic acid, maleic acid, maleic anhydride, chloromaleic acid, chloromaleic anhydride, acrylic acid, methacrylic acid, crotonic acid, cinnamic acid, etc.

Preferred olefin polymers for reaction with the unsaturated dicarboxylic acids or derivatives thereof are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene: or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the dispersants will usually have number average molecular weights within the range of about 700 and about 5,000, more usually between about 800 and about 3000. Particularly useful olefin polymers have number average molecular weights within the range of about 900 and about 2500 with approximately one terminal double bond per polymer chain. An especially useful starting material for highly potent dispersant additives is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for reacting the olefin polymer with the $C_{4-10}$ unsaturated dicarboxylic acid, anhydride or ester are known in the art. For example, the olefin polymer and the dicarboxylic acid or derivative may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8 wt. %, preferably 3 to 7 wt. % chlorine, or bromine, based on the weight of polymer, by passing the chlorine or bromine through the polyolefin at a temperature of 60° to 250° C., e.g. 120° to 160° C., for about 0.5 to 10, preferably 1 to 7 hours. The halogenated polymer may then be reacted with sufficient unsaturated acid or derivative at 100° to 250° C., usually about 180° to 235° C., for about 0.5 to 10, e.g. 3 to 8 hours, so the product obtained will contain the desired number of moles of the unsaturated acid or derivative per mole of the halogenated polymer. Processes of this general type are taught in U.S. Pat. Nos. 3,087,936, 3,172,892, 3,272,746 and others.

Alternatively, the olefin polymer, and the unsaturated acid or derivative are mixed and heated while adding chlorine to the hot material. Processes of this type are disclosed in U.S. Pat. Nos. 3,215,707, 3,231,587, 3,912,764, 4,110,349, and in U.K. 1,440,219.

By the use of halogen, about 65 to 95 wt. % of the polyolefin, e.g. polyisobutylene will normally react with the dicarboxylic acid or derivative. Upon carrying out a thermal reaction without the use of halogen or a catalyst, then usually only about 50 to 75 wt. % of the polyisobutylene will react Chlorination helps increase the reactivity.

At least one hydrocarbyl-substituted dicarboxylic acid material is mixed with at least one of amine, alcohol, including polyol, aminoalcohol, etc., to form the dispersant additives. When the acid material is further reacted, e g., neutralized, then generally a major proportion of at least 50 percent of the acid producing units up to all the acid units will be reacted.

Amine compounds useful as nucleophilic reactants for neutralization of the hydrocarbyl-substituted dicarboxylic acid materials include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

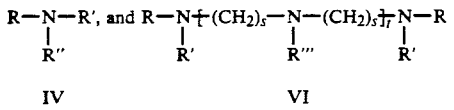

IV VI wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

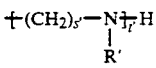

VII wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formulas V and VI with typically at least one primary or secondary amine group, preferably at least two primary or secondary amine groups. This can be achieved by selecting at least one of said R, R', R'' or R''' groups to be hydrogen or by letting t in Formula VI be at least one when R''' is H or when the VII moiety possesses a secondary amino group. The most preferred amine of the above formulas are represented by Formula V and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2- propylene diamine; di-(1,2-propylene)triamine; di-(1,3- propylene) triamine; N,N-dimethyl-1,3-diaminopropane; N,N- di-(2-aminoethyl) ethylene diamine; N,N-di(2-hydroxyethyl)- 1,3-propylene diamine; 3-dodecyloxypropylamine; N-dodecyl- 1,3-propane diamine; trishydroxymethylaminomethane (THAM); diisopropanol amine; diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general Formula (VIII):

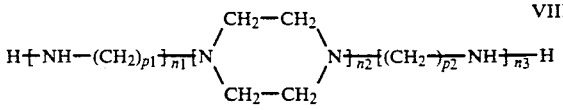

VIII wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc. Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulas:

$$NH_2\text{-alkylene- o-alkylene}_m\text{- }NH_2 \qquad \text{IX}$$

where m has a value of about 3 to 70 and preferably 10 to 35; and $$R[\text{alkylene-(o-alkylene)}_n NH_2]_a \qquad \text{X}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either Formula IX or X may be straight or branched chains containing about 2 to 7, and preferably about 2 to 4 carbon atoms.

The polyoxyalkylene polyamines of Formulas IX or X above, preferably polyoxyalkylene diamines and polyoxyalkylene triamines, may have average molecular weights ranging from about 200 to about 4000, and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D- 2000, T-403", etc.

The amine is readily reacted with the selected hydrocarbyl-substituted dicarboxylic acid material, e.g. alkenyl succinic anhydride, by heating an oil solution containing 5 to 95 wt. % of said hydrocarbyl-substituted dicarboxylic acid material to about 100° to 250° C., preferably 125° to 1750C., generally for 1 to 10, e.g. 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition, having a functionality of 1.6, derived from reaction of polyolefin and maleic anhydride; i.e., preferably the pentamine is used in an amount sufficient to provide about 0.4 equivalents (that is, 1.6 divided by $(0.8\times5)$ equivalents) of succinic anhydride units per reactive nitrogen equivalent of the amine.

The ashless dispersant esters are derived from reaction of the aforesaid long chain hydrocarbyl-substituted dicarboxylic acid material and hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, monooleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether alcohols and amino alcohols including, for example, the oxyalkylene-, oxyarylene-, aminoalkylene-, and aminoarylene-substituted alcohols having one or more oxyalkylene, oxyarylene, amino- alkylene or aminoarylene radicals. They are exemplified by Cellosolve, Carbitol, N,N,N',N'-tetrahydroxy-trimethylene diamine, and ether alcohols having up to about 150 oxyalkylene radicals in which the alkylene radical contains from 1 to about 8 carbon atoms.

The ester dispersant may be diesters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. Nos. 3,381,022 and 3,836,471.

Hydroxyl amines which can be reacted with the aforesaid long chain hydrocarbon substituted dicarboxylic acid materials to form dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxypropyl)-N'-(beta-aminoethyl)-piperazine, tris(hydroxy-methyl) aminomethane (also known as trismethylolaminomethane), 2-amino-1-butanol, ethanolamine, beta-(beta-hydroxyethoxy)ethylamine, and the like. Mixtures of these or similar amines can also be employed. The above description of nucleophilic reactants suitable for reaction with the hydrocarbyl-substituted dicarboxylic acid material includes amines, alcohols, and compounds of mixed amine and hydroxy containing reactive functional groups, i.e., aminoalcohols.

A preferred group of ashless dispersants are those derived from polyisobutylene substituted with succinic anhydride groups and reacted with said polyethylene amines, e.g. tetraethylene pentamine, pentaethylene hexamine, polyoxyethylene and polyoxypropylene amines, e.g. polyoxypropylene diamine, trismethylolaminomethane, or said above-described alcohols such as pentaerythritol, and combinations thereof. One class of particularly preferred dispersants includes those derived from polyisobutene substituted with succinic anhydride groups and reacted with (i) a hydroxy compound, e.g. pentaerythritol, (ii) a polyoxyalkylene polyamine, e.g. polyoxypropylene diamine, and/or (iii) a polyalkylene polyamine, e.g. polyethylene diamine or tetraethylene pentamine. Another preferred dispersant class includes those derived from polyisobutenyl succinic anhydride reacted with (i) a polyalkylene polyamine, e.g. tetraethylene pentamine, and/or (ii) a polyhydric alcohol or polyhydroxy-substituted aliphatic primary amine, e.g. pentaerythritol or trismethylolaminomethane.

2. Reaction products of relatively high molecular weight aliphatic or alicyclic halides with amines, preferably polyalkylene polyamines. These may be characterized as "amine dispersants" and examples thereof are described for example, in the U.S. Pat. Nos. 3,454,555 and 3,565,804.

3. Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Patents are illustrative:

U.S. Pat. No. 3,725,277
U.S. Pat. No. 3,725,480
U.S. Pat. No. 3,726,882
U.S. Pat. No. 3,980,569

4 Products obtained by post-treating the carboxylic, amine or Mannich dispersants with such reagents as urea, thiourea, carbon disulfide, aldehydes, ketones, carboxylic acids, hydrocarbon-substitued succinic anhydrides, nitriles, epoxides, boron compounds, phosphorus compounds or the like. Exemplary materials of this type are described in the following U.S. patents:

U.S. Pat. No. 3,087,936
U.S. Pat. No. 3,254,025
U.S. Pat. No. 3,703,536
U.S. Pat. No. 3,704,308
U.S. Pat. No. 3,708,422
U.S. Pat. No. 4,113,639
U.S. Pat. No. 4,116,876

More specifically, the nitrogen and ester containing dispersants preferably are further treated by boration as generally taught in U.S. Pat. Nos. 3,087,936 and 3,254,025 (incorporated herein by reference). This is readily accomplished by treating the selected nitrogen dispersant with a boron compound selected from the class consisting of boron oxide, boron halides, boron acids and esters of boron acids in an amount to provide from about 0.1 atomic proportion of boron for each mole of said nitrogen dispersant to about 20 atomic proportions of boron for each atomic proportion of nitrogen of said nitrogen dispersant. Usefully borated dispersants contain from about 0.05 to 2.0 wt. %, e.g. 0.05 to 0.7 wt. % boron based on the total weight of said borated nitrogen dispersant. The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said nitrogen dispersant) of said boron compound, preferably boric acid which is most usually added as a slurry to said nitrogen dispersant and heating with stirring at from about 135° to 190° C., e.g. 140°-170° C., for from 1 to 5 hours followed by nitrogen stripping at said temperature ranges. Or, the boron treatment can be carried out by adding boric acid to the hot reaction mixture of the dicarboxylic acid material and amine while removing water.

5 Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

U.S. Pat. No. 3,329,658
U.S. Pat. No. 3,519,565
U.S. Pat. No. 3,666,730
U.S. Pat. No. 3,702,300

All of the above-noted patents are incorporated by reference herein for their disclosures of ashless dispersants.

Lubricating oil flow improvers (LOFI) include all those additives which modify the size, number, and growth of wax crystals in lube oils in such a way as to impart improved low temperature handling, pumpability, and/or vehicle operability as measured by such tests as pour point and mini-rotary viscometry (MRV). The majority of lubricating oil flow improvers are polymers or contain polymers. These polymers are generally of two types, either backbone or sidechain.

The backbone variety, such as the ethylene-vinyl acetates (EVA), have various lengths of methylene segments randomly distrubuted in the backbone of the polymer, which associate or cocrystallize with the wax crystals inhibiting further crystal growth due to branches and non-crystalizable segments in the polymer.

The sidechain type polymers, which are the predominant variety used as LOFI's, have methylene segments as the side chains, preferably as straight side chains. These polymers work similarly to the backbone type except the side chains have been found more effective in treating isoparaffins as well as n-paraffins found in lube oils. Representative of this type of polymer are $C_8$-$C_{18}$ dialkylfumarate/vinyl acetate copolymers, polyacrylates, polymethacrylates, and esterified styrene-maleic anhydride copolymers.

Foam control can be provided by an anti-foamant of the polysiloxane type, e.g. silicone oil and polydimethyl siloxane.

Anti-wear agents, as their name implies, reduce wear of moving metallic parts. Representative of conventional anti-wear agents are the zinc dialkyl dithiophosphates, and the zinc diaryl dithiophosphates. It is an advantage of the present invention that supplemental anti-wear agents do not have to be employed and, in fact, can be excluded from the compositions of this invention.

Seal swellants include mineral oils of the type that provoke swelling, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g. dihexyl phthalate, as are described in U.S. Pat. No. 3,974,081.

Some of these numerous additives can provide a multiplicity of effects e.g. a dispersant oxidation inhibitor. This approach is well known and need not be further elaborated herein.

Compositions, when containing these additives, typically are blended into the base oil in amounts which are effective to provide their normal attendant function. Representative effective amounts of such additives are illustrated in Table 3 as follows:

TABLE 3

| Compositions | (Broad) Wt % | (Preferred) Wt % |
|---|---|---|
| V.I. Improver | 1-12 | 1-4 |
| Corrosion Inhibitor | 0.01-3 | 0.01-1.5 |
| Oxidation inhibitor | 0.01-5 | 0.01-1.5 |
| Dispersant | 0.1-10 | 0.1-8 |
| Lube Oil Flow Improver | 0.01-2 | 0.01-1.5 |
| Detergents and Rust Inhibitors | 0.01-6 | 0.01-3 |
| Anti-Foaming Agents | 0.001-0.1 | 0.001-0.15 |
| Anti-wear Agents | 0.001-5 | 0.001-1.5 |
| Seal Swellant | 0.1-8 | 0.1-6 |
| Friction Modifiers | 0.01-3 | 0.01-1.5 |
| Lubricating Base Oil | Balance | Balance |

In a broad sense therefore, the organic phosphite ester and the hydroxyl amine compound additives of the present invention, when employed in a lubricating oil composition, typically in a minor amount, are effective to impart enhanced anti-wear, friction modification, and oxidation inhibition properties thereto, relative to the same composition in the absence of the additive combination. Additional conventional additives selected to meet the particular requirements of a selected type of lubricating oil composition also can be included as desired.

Accordingly, while any effective amount of the organic phosphite ester additive can be incorporated into a lubricating oil composition, it is contemplated that such effective amount be sufficient to provide a given composition with an amount of the organic phosphite ester additive of typically from about 0.01 to about 10 (e.g., 0.01 to 5), preferably from about 0.05 to about 5.0 (e.g, 0.1 to 1.0), and most preferably from about 0.2 to about 0.6 wt. %, based on the weight of said composition. Similarly, while any effective amount of the hydroxyl amine additive can be incorporated into an oil composition, it is contemplated that such effective amount be sufficient to provide said composition with an amount of the hydroxyl amine additive of typically from about 0.01 to about 10, preferably from about 0.05 to about 5 (e.g., 0.1 to 1), and most preferably from about 0.1 to about 0.5 wt. %, based on the weight of said composition. Thus, generally speaking, the weight ratio of the organic phosphite ester to the hydroxyl amine compound in the final lubricating oil compositions of this invention will be on the order of from about 0.01-10: 0.01-10.

When other additives are employed, it may be desirable, although not necessary, to prepare additive concentrates comprising concentrated solutions or dispersions of the organic phosphite ester and the hydroxyl amine compound together with the other additives (said concentrate additive mixture being referred to herein as an additive package) whereby the several additives can be added simultaneously to the base oil to form the lubricating oil compositions. Dissolution of the additive concentrate into the lubricating oil may be facilitated by solvents and by mixing accompanied with mild heating, but this is not essential. The concentrate or additive package will typically be formulated to contain the organic phosphite ester and the hydroxyl amine compound combination of this invention and optional additional additives in proper amounts to provide the desired concentration in the final formulation when the additive package is combined with a predetermined amount of base lubricant. Thus, the organic phosphite ester and hydroxyl amine compound can be added to small amounts of base oil or, optionally, to other compatible solvents, along with other desirable additives to form concentrates containing active ingredients in collective amounts of typically from about 25 to about 100, and preferably from about 65 to about 95, and most preferably from about 75 to about 90 wt. % additives in the appropriate proportions, with the remainder being base oil. As is the case with lubricating oil compositions which contain the present combination of additives, the concentrates contemplated herein may contain a weight ratio of organic phosphite ester to hydroxyl amine compound typically of from about 0.01-10:0.01-10.

The final formulation may employ typically about 10 wt. % of the additive package with the remainder being base oil.

All of said weight percents expressed herein are based on active ingredient (a.i.) content of the additive, and/or upon the total weight of any additive package, or formulation which will be the sum of the a.i. weight of each additive plus the weight of total oil or diluent.

As noted above, the organic phosphite esters contemplated for use in this invention are characterized as possessing good friction modification properties as well as anti-wear properties. This has the added benefit of permitting a reduction in the amount of hydroxyl amine compound or other friction modifier needed to achieve the overall desired friction modification. It has been found that as the amount of hydroxyl amine compound or other friction modifier increases in an ATF, the lower the breakaway static torque becomes. As the breakaway static torque (as well as the breakaway static coefficient of friction) decreases, the bands of the automatic transmission become increasingly more susceptible to slippage. Consequently, it is extremely advantageous to be able to control, e.g. reduce, the amount of friction modifier (and hence also any associated friction stability promoter) without sacrificing the friction modifying properties of the fluid, e.g., as measured by torque differential $T_O - T_D$ or coefficients thereof and stability thereof, since this facilitates the simultaneous achievement of both the desired breakaway static torque and torque differential friction characteristics. It has also been found that the use of both the organic phosphite ester and the hydroxyl amine additive results in a lubricating oil composition that possesses excellent oxidation inhibition and friction durablility and reduced corrosivity relative to an additive combination that does not include the hydroxyl amine additive.

In short, the combination of the organic phosphite ester and the hydroxyl amine compound permits the formulator to flexibly tailor an ATF in order to achieve the balance of properties required under today's more stringent transmission manufacturers' specifications.

The following examples are given as specific illustrations of the claimed invention. It should be understood, however, that the invention is not limited to the specific details set forth in the examples. All parts and percentages in the examples as well as in the remainder of the specification and claims are by weight unless otherwise specified.

EXAMPLE 1 Part A

A polyisobutenyl succinic anhydride (PIBSA) having a succinic anhydride (SA) to polyisobutylene (PIB) ratio (SA:PIB), i.e. functionality, of 1.04 was prepared by heating a mixture of 100 parts of polyisobutylene (PIB) having a number average molecular weight (Mn) of 940 with 13 parts of maleic anhydride to a temperature of about 220° C. When the temperature reached 120° C., chlorine addition was begun and 1.05 parts of chlorine at a constant rate were added to the hot mixture for about 5 hours. The reaction mixture was then heat soaked at 220° C. for about 1.5 hours, and then stripped with nitrogen for about 1 hour. The resulting polyisobutenyl succinic anhydride had an ASTM Saponification Number of 112 which calculates to a succinic anhydride (SA) to polyisobutylene (PIB) ratio of 1.04 based upon the starting PIB as follows:

SA:PIB ratio =

$$\frac{SAP \times M_n}{112200 - (96 \times SAP)} = \frac{112 \times 940}{112200 - (96 \times 112)} = 1.04$$

The PIBSA product was 90 wt. % active ingredient (a.i.), the remainder being primarily unreacted PIB. The SA:PIB ratio of 1.04 is based upon the total PIB charged to the reactor as starting material, i.e., both the PIB which reacts and the PIB which remains unreacted.

Part B

The PIBSA of Part A was aminated as follows: 1500 grams (1.5 moles) of the PIBSA and 1666 grams of S150N lubricating oil (solvent neutral oil having a viscosity of about 150 SSU at 100° C.) were mixed in a reaction flask and heated to about 149° C. Then, 193 grams (1 mole) of a commercial grade of polyethyleneamine which was a mixture of polyethyleneamines averaging about 5 to 7 nitrogen per molecule, hereinafter referred to as PAM, was added and the mixture was heated to 150° C. for about 2 hours; followed by 0.5 hours of nitrogen stripping, then cooling to give the final product (PIBSA-PAM). This product had a viscosity of 140 cs. at 100° C., a nitrogen content of 2.12 wt. % and contained approximately 50 wt. % PIBSA-PAM and 50 wt. % unreacted PIB and mineral oil (S150N).

EXAMPLE 2

A borated PIBSA-PAM was prepared by mixing 98 parts by weight of the PIBSA-PAM prepared in accordance with the procedure of EXAMPLE 1, Part B, with 2 parts by weight of boric acid. The mixture was heated to 160° C. while stirring and blowing the reaction mass with nitrogen. The mixture was kept at 160° C. for 2 hours, spargedwith nitrogen for 1 hour and filtered. The resulting product was analyzed for 0.35 % boron.

EXAMPLE '

An ATF base fluid was prepared with conventional amounts of seal swell additive, anti-oxidant, viscosity index improver and mineral oil base.

To a sample of this base fluid there was added 4.4 vol. % of the borated PIBSA-PAM dispersant of EXAMPLE 2. The resulting composition is designated hereinafter as Test Base Fluid.

To a sample of the Test Base fluid there was added 0.5 vol. % of triphenyl phosphite (TPP), and 0.1 vol. % of a hydroxyl amine friction modifier in accordance with Formula II:

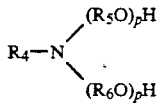

II wherein $R_4$ is a $C_{18}$ aliphatic hydrocarbon radical, $R_5$ and $R_6$ are $C_2$ alkylene and p is 1. The hydroxyl amine compound is a commercial product which is available under the trade designation Ethomeen 18-12 from the Armak Chemical Division of Akzo Chemie. The resulting formulation is designated Formulation 1.

To another sample of Test Base Fluid there was added 0.5 vol. % of TPP and 0.2 vol. % of the friction modifier used in Formulation 1. The resulting formulation is designated as Formulation 2.

To another sample of Test Base Fluid there was added 0.5 vol. % of TPP and 0.4 vol. % of the friction modifier used in Formulation 1. The resulting formulation is designated as Formulation 3.

To another sample of Test Base Fluid there was added 0.5 vol. % of TPP and 1.0 vol. % of the friction modifier used in Formulation 1. The resulting formulation is designated as Formulation 4.

To another sample of the Test Base Fluid there was 0.5 vol. % of TPP and 0.25 vol. % of a hydroxyl amine friction modifier having the Formula III:

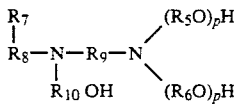

III wherein $R_7$ is H, $R_8$ is $C_{18}$ alkylene, $R_9$ is $C_3$ alkylene, $R_5$, $R_6$ and $R_{10}$ are $C_2$ alkylene and p is 1. The hydroxyl amine compound is a commerical product which is available under the trade designation Ethoduomeen T-13 from the Armak Chemical Division of Akzo Chemie. The resulting formulation is designed Formulation 5.

To another sample of the Test Base Fluid there was added 0.5 vol. % of TPP and 1.0 vol. % of 2,2-thiodiethylene (bis-octadecenyl succinic acid) calcium salt (45% A.I.) friction modifer. The resulting formulation is designated Comparative Formulation 6C.

To another sample of the Test Base Fluid there was added 0.5 vol. % of TPP and 1.5 vol. % of 2,2-thiodiethylene (bis-octadecenyl succinic acid) calcium salt (45% A.I.) friction modifer. The resulting formulation is designated Comparative Formulation 7C.

To another sample of the Test Base Fluid there was added 0.5 vol. % of a triphenyl phosphite and 0.5 vol. % of 2,2-thiodiethylene (bis-octadecenyl succinic acid) friction modifier. The resulting formulation is designated as Comparative Formulation 8C.

To another sample of the Test Base Fluid there was added 0.5 vol. % triphenyl phosphite and 0.75 vol. % 2,2-thiodiethylene (octadecenyl succinic acid) friction modifier. The resulting formulation is designated as Comparative Formulation 9C.

To another sample of the Test Base Fluid there was added 0.5 vol. % triphenyl phosphite and 0.23 vol. % octadecenyl succinic anhydride friction modifier and 0.1 vol% of ZDDP. The resulting formulation is designated as Comparative Formulation 10C.

The compositions of Formulations 1-10C are summarized in Table 4.

TABLE 4

| | Formulation Number | | | | | | | | | |
|---|---|---|---|---|---|---|---|---|---|---|
| Component | 1 | 2 | 3 | 4 | 5 | 6C | 7C | 8C | 9C | 10C |
| triphenyl phosphite | 0.5 | 0.5 | 0.5 | 0.5 | 0.5 | 0.5 | 0.5 | 0.5 | 0.5 | 0.5 |
| hydroxyl amine-Formula II | 0.1 | 0.2 | 0.4 | 1.0 | 0 | 0 | 0 | 0 | 0 | 0 |
| hydroxyl amine-Formula III | 0 | 0 | 0 | 0 | 0.25 | 0 | 0 | 0 | 0 | 0 |
| 2,2-thiodiethylene (bis-octadecenyl succinic acid) | 0 | 0 | 0 | 0 | 0 | 0 | 0 | 0.5 | 0.75 | 0 |
| Octadecenyl succinic anhydride | 0 | 0 | 0 | 0 | 0 | 0 | 0 | 0 | 0 | 0.23 |
| Ca salt of 2,2-thiodiethylene (bis-octadecenyl succinic acid) | 0 | 0 | 0 | 0 | 0 | 1.0 | 1.5 | 0 | 0 | 0 |
| ZDDP | 0 | 0 | 0 | 0 | 0 | 0 | 0 | 0 | 0 | 0.10 |
| Test Base Fluid[1] | bal | bal | bal | bal | bal | bal | bal | bal | bal | bal |

[1]Test Base 1 prepared using 4.4 vol. % borated PIBSA-PAM dispersant.

The Formulations 1 to 10 were then tested in accordance with a modified SAE No. 2 Friction Test.

THE MODIFIED SAE NO. 2 FRICTION TEST

This test uses a SAE No. 2 type friction machine operated successfully for 1000 cycles wherein no unusual clutch plate wear or composition-face plate flaking occurs. The test is conducted in a continuous series of 20 second cycles, each cycle consisting of three phases as follows: Phase I (10 seconds)—motor on at speed of 3,600 rpm, clutch plates disengaged; Phase II (5 seconds)—motor off, clutch plates engaged; and Phase III (5 seconds)—motor off, clutch plates releases. 200 cycles are repeated using 11,600 ft./lbs. of flywheel torque at 40 psig of applied clutch pressure. During the clutch engagement, friction torque is recorded as a function of time as the motor speed declines from 3600 rpm to 0. The dynamic coefficient of friction ($\mu_D$) is determined midway between the start and end of clutch engagement (i.e. at a motor speed of 1800 rpm), as well as the coefficient of friction at 200 rpm ($\mu_o$) The amount of time in seconds in phase II it takes for the motor speed to go from 3600 to 0 rpm is referred to as the lock-up time. The ratio of the oil formulation is then determined from $\mu_o/\mu_D$. In addition to determining midpoint dynamic coefficient of friction ($\mu_D$) and coefficient of friction at 200 rpm ($\mu_o$), the breakaway static coefficient of friction ($\mu_s$) is also determined. This is achieved by rotating the composition plates at 2 to 3 rpm under a load of 40 psi. while locking the steel reaction plates and preventing them from rotating. The coefficient of friction is then measured until slippage occurs. The maximum coefficient of static friction observed is recorded at $\mu_s$. From $\mu_s$ is determined the Breakaway Static ratio ($\mu_s/\mu_D$).

The breakaway static ratio expresses the ability of the transmission to resist slippage; the lower the ratio, the higher the slippage.

The test results for Formulation 1-10 are shown in Table 5. The data reported in Table 5 is derived from the 200th cycle of operation.

TABLE 5

| Data after 200 cycles | 1 | 2 | 3 | 4 | 5 | 6C | 7C | 8C | 9C | 10C |
|---|---|---|---|---|---|---|---|---|---|---|
| Dynamic Coefficient of Friction at 1800 rpm ($\mu_D$) | .136 | .131 | .127 | .127 | .141 | .145 | .138 | .140 | .141 | .138 |
| Coefficient of Friction at 200 rpm ($\mu_O$) | .145 | .135 | .122 | .118 | .147 | .155 | .141 | .150 | .147 | .154 |
| Breakaway Static Friction ($\mu_S$) | .142 | .113 | .092 | .082 | .155 | .152 | .140 | .155 | .155 | .154 |
| $\mu_S/\mu_D$ | 1.04 | .86 | .72 | .65 | 1.10 | 1.05 | 1.01 | 1.11 | 1.10 | 1.12 |
| $\mu_C/\mu_D$ | 1.07 | .98 | .96 | .93 | 1.04 | 1.07 | 1.02 | 1.07 | 1.04 | 1.12 |

Referring to Table 5, it can be seen that $\mu_o/\mu_D$ is substantially lower for Formulations 2, 3 and 4 than for comparative Formulations 6C-10C which do not contain the hydroxyl amine friction modifier and which are outside the scope of the present invention. The higher $\mu_o/\mu_D$ for the comparative formulations indicates that their use will cause shudder in the shift characteristics of a transmission. Normally, a value for $\mu_o/\mu_D$ of 1.0 or less is required for satisfactory operation.

The data in Table 5 also show that the values for $\mu_o/\mu_D$ for Formulations 1 and 5, both of which contain relatively small amounts of hydroxyl amine friction modifier, are about the same as the values for $\mu_o/\mu_D$ for comparative formulations 6C-10C, even through the comparative formulations contain as much as fifteen times the amount of friction modifier as do Formulations 1 and 5. The data in Table 5 thus demonstrate the superiority of the present organic phosphite/hydroxyl amine additive combination over similar additive combinations wherein commercial friction modifiers are substituted for the hydroxyl amine friction modifier.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A lubricating oil composition adaptable for use as a power transmitting fluid which comprises:

(a) lubricating oil;

(b) a friction modifying amount of borated or unborated hydroxyl amine compound having one of the following Formulas II or III:

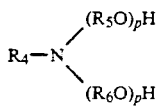

II

-continued

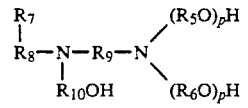

III wherein $R_4$ represents a $C_7$-$C_{28}$ saturated or unsaturated aliphatic hydrocarbon radical; $R_5$ and $R_6$ represent the same or different straight or branched chain $C_2$-$C_6$ alkylene radical; $R_7$ represents H or $CH_3$; $R_8$ represents a $C_7$-$C_{27}$ straight or branched chain alkylene radical; $R_9$ represents a straight or branched chain $C_1$-$C_5$ alkylene radical; $R_{10}$ represents a straight or branched chain $C_1$-$C_5$ alkylene radical; and p, independently, represents 1-4; and (c) an amount of an organic phosphite ester effective to impart both anti-wear and friction modification to the composition, said organic phosphite ester having the formula:

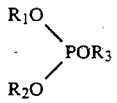

I wherein $R_1$, $R_2$ and $R_3$, independently, represent the same or different aryl or alkyl-substituted aryl hydrocarbyl radical having from about 6 to about 30 carbon atoms.

2. The lubricating oil composition of claim 1, wherein said friction modifying hydroxyl amine compound is characterized by formula II and $R_4$ is a $C_{10}$-$C_{20}$ alkylene radical.

3. The lubricating oil composition of claim 2, wherein $R_4$ represents a $C_{12}$-$C_{18}$ alkylene radical, and $R_5$ and $R_6$ each represent a $C_2$-$C_4$ alkylene radical.

4. The lubricating oil composition of claim 3, wherein $R_4$ is a $C_{18}$ saturated or unsaturated aliphatic hydrocarbon radical, $R_5$ and $R_6$ each are $C_2$ alkylene, and p is 1.

5. The lubricating oil composition of any one of claims 2 to 4, further comprising a dispersing amount of an ashless carboxylic dispersant material comprising the reaction product of (a) hydrocarbyl-substituted $C_4$ to $C_{10}$ dicarboxylic acid material having a functionality of from about 0.5 to about 2.8 and being derived from reaction of polyolefin having a number average molecular weight of from about 700 to about 5,000, and monounsaturated $C_4$ to $C_{10}$ dicarboxylic acid material wherein (i) said carboxyl groups are located on adjacent carbon atoms and (ii) at least one of said adjacent carbon atoms forms part of said monounsaturation; and (b) polyamine.

6. The lubricating oil composition of claim 5, wherein said ashless carboxylic dispersant material is borated.

7. The lubricating oil composition of any one of claims 1 to 4, wherein $R_1$, $R_2$ and $R_3$ represent the phenyl radical.

8. The lubricating oil composition of claim 1, wherein said friction modifying hydroxyl amine compound is characterized by the Formula III.

9. The lubricating oil composition of claim 8, wherein $R_8$ represents a $C_{10}$–$C_{20}$ alkylene radical and $R_{10}$ represents a $C_2$–$C_4$ alkylene radical.

10. The lubricating oil composition of claim 9, wherein $R_7$ is H, $R_5$ and $R_6$ are $C_2$ alkylene, and p is 1.

11. The lubricating oil composition of any one of claims 9 and 10, wherein $R_1$, $R_2$ and $R_3$ represent the phenyl radical.

12. The lubricating oil composition of claim 5, wherein said ashless carboxylic dispersant material is derived from polyisobutenyl-substituted succinic acid material.

13. The lubricating oil composition of claim 6, wherein said ashless carboxylic dispersant material is derived from polyisobutenyl-substituted succinic acid mater al.

14. The lubricating oil composition of claim 1, wherein said hydroxyl amine compound has been borated.

15. The lubricating oil composition of claim 4, wherein said hydroxyl amine compound has been borated.

16. The lubricating oil composition of claim 8, wherein said hydroxyl amine compound has been borated.

17. The lubricating oil composition of claim 5, wherein said polyamine reactive component (b) is selected from the group consisting of polyamines having about 2 to 60 total carbon atoms and about 2 to 12 nitrogen atoms in the molecule.

18. The lubricating oil composition of claim 6, wherein said polyamine is an aliphatic saturated amine having the general formula:

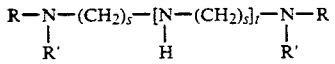

wherein R and R′ independently are the different and are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals; each s is the same or a different number of from 2 to 6; and t is a number of from 0 to 10, with the proviso that when t=0, at least one of R or R′ must be H such that there are at least two of either primary or secondary amino groups.

19. An additive concentrate comprising a base oil in an amount up to about 75 wt. % and from about 25 wt. % up to about 100 wt. % of said concentrate of a mixture comprised of:

(a) a friction modifying hydroxyl amine compound having one of the following Formulas II or III:

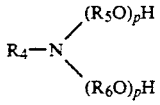

II

-continued

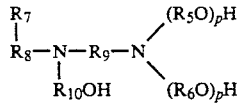

III wherein $R_4$ represents a $C_7$–$C_{28}$ saturated or unsaturated aliphatic hydrocarbon radical; $R_5$ and $R_6$ represent the same or different straight or branched chain $C_2$–$C_6$ alkylene radical; $R_7$ represents H or $CH_3$; $R_8$ represents a $C_7$–$C_{27}$ straight or branched chain alkylene radical; $R_9$ represents a straight or branched chain $C_1$–$C_5$ alkylene radical; $R_{10}$ represents a straight or branched chain $C_1$–$C_5$ alkylene radical; and p, independently, represents 1–4; and (b) an anti-wear and friction modifying organic phosphite ester having the formula:

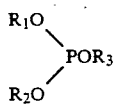

I wherein $R_1$, $R_2$ and $R_3$, independently, represent the same or different aryl or $C_3$–$C_6$ alkyl-substituted aryl hydrocarbyl radical.

20. The concentrate of claim 19, wherein said hydroxyl amine compound is characterized by Formula II and $R_4$ is a $C_{10}$–$C_{20}$ alkylene radical.

21. The concentrate of claim 20, wherein $R_4$ represents a $C_{12}$–$C_{18}$ alkylene radical and $R_5$ and $R_6$ represent a $C_2$–$C_4$ alkylene radical.

22. The concentrate of claim 21, wherein $R_4$ is a $C_{18}$ saturated or unsaturated aliphatic hydrocarbon radical, $R_5$ and $R_6$ each are $C_2$ alkylene, and p is 1.

23. The concentrate of claim 22, wherein $R_1$, $R_2$ and $R_3$ represent the phenyl radical.

24. The concentrate of claim 19, further comprising a dispersing amount of an ashless carboxylic dispersant material.

25. The concentrate of claim 24, wherein said ashless carboxylic dispersant material comprises the reaction product of (a) hydrocarbyl-substituted $C_4$ to $C_{10}$ dicarboxylic acid material having a functionality of from about 0.5 to about 2.8 and being derived from reaction of polyolefin having a number average molecular weight of from about 700 to about 5,000, and monounsaturated $C_4$ to $C_{10}$ dicarboxylic acid material wherein (i) said carboxyl groups are located on adjacent carbon atoms and (ii) at least one of said adjacent carbon atoms forms part of said monounsaturation; and (b) polyamine.

26. The concentrate of claim 24, wherein said hydroxyl amine compound is characterized by Formula II and $R_4$ is a $C_{10}$–$C_{20}$ alkylene radical.

27. The concentrate of claim 26, wherein $R_4$ represents a $C_{12}$–$C_{18}$ alkylene radical and $R_5$ and $R_6$ represent a $C_2$–$C_4$ alkylene radical.

28. The concentrate of claim 27, wherein $R_4$ is a $C_{18}$ saturated or unsaturated aliphatic hydrocarbon radical, $R_5$ and $R_6$ each are $C_2$ alkylene, and p is 1.

29. The concentrate of claim 28, wherein $R_1$, $R_2$ and $R_3$ represent the phenyl radical.

30. The concentrate of claim 25, wherein said hydroxyl amine compound is characterized by Formula II and $R_4$ is a $C_{10}$–$C_{20}$ alkylene radical.

31. The concentrate of claim 30, wherein $R_4$ is a $C_{12}$–$C_{18}$ alkylene radical and $R_5$ and $R_6$ represent a $C_2$–$C_4$ alkylene radical.

32. The concentrate of claim 31, wherein $R_4$ is a $C_{18}$ saturated or unsaturated aliphatic hydrocarbon radical, $R_5$ and $R_6$ each are $C_2$ alkylene, and p is 1.

33. The concentrate of claim 32, wherein $R_1$, $R_2$ and $R_3$ represent the phenyl radical.

34. The concentrate of claim 19, wherein said hydroxyl amine compound is characterized by the Formula III.

35. The concentrate of claim 25, wherein said dispersant material is a polyisobutenyl-substituted succinic acid-polyamine reaction product.

36. The concentrate of claim 35, wherein said dispersant material comprises a borated polyisobutenyl succinimide.

37. The concentrate of claim 36, wherein the polyamine reactant is selected from the group consisting of polyamines having about 2 to 60 total carbon atoms and about 2 to 12 nitrogen atoms in the molecule.

38. A lubricating oil composition adapted for use as an automatic transmission fluid which comprises:

(a) a lubricating oil;

(b) from about 0.01 to about 10 wt. % of a hydroxyl amine compound having one of the following Formulas II or III:

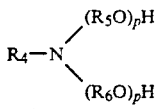

II

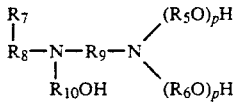

III wherein $R_4$ represents a $C_7$–$C_{28}$ saturated or unsaturated aliphatic hydrocarbon radical; $R_5$ and $R_6$ represent the same or different straight or branched chain $C_2$–$C_6$ alkylene radical; $R_7$ represents H or $CH_3$; $R_8$ represents a $C_7$–$C_{27}$ straight or branched chain alkylene radical; $R_9$ represents a straight or branched chain $C_1$–$C_5$ alkylene radical; $R_{10}$ represents a straight or branched chain $C_1$–$C_5$ alkylene radical; and p, independently, represents 1–4; and (c) from about 0.01 to about 15 wt. % of an organic phosphite ester effective to impart at least one of the properties of anti-wear, oxidation inhibition and friction modification to the composition, said organic phosphite ester having the formula:

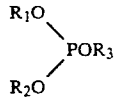

I wherein $R_1$, $R_2$ and $R_3$, independently, represent the same or different aryl or alkyl-substituted aryl hydrocarbyl radical having from about 6 to about 18 carbon atoms.

39. The lubricating oil composition of claim 38, further comprising from about 0.1 to about 8 wt. % of a borated, dispersant material comprising the reaction product of (i) the reaction product of (a) hydrocarbyl-substituted $C_4$ to $C_{10}$ dicarboxylic acid material having a functionality of from about 0.5 to about 2.8 derived from the reaction of a polyolefin having a number average molecular weight of from about 700 to about 5,000, and monounsaturated $C_4$ to $C_{10}$ dicarboxylic acid material wherein the carboxyl groups are located on adjacent carbon atoms and at least one of said adjacent carbon atoms forms part of said monounsaturation and (b) a polyamine; and (ii) a boron compound consisting of a boric oxide, a boron halide, a metaborate, boric acid, or a mono-, di-, and trialkyl borate.

40. The lubricating oil composition of claim 39, wherein said hydroxyl amine compound is characterized by Formula II and $R_4$ is a $C_{10}$–$C_{20}$ alkylene radical.

41. The lubricating composition of claim 39, wherein said organic phosphite ester is triphenyl phosphite. phosphite.

42. The lubricating oil composition of claim 40, wherein $R_4$ represents a $C_{12}$–$C_{18}$ alkylene radical and $R_5$ and $R_6$ each represent a $C_2$–$C_4$ alkylene radical.

43. The lubricating oil composition of claim 42, wherein said organic phosphite ester is triphenyl phosphite.

44. A process for improving at least one of the properties of anti-wear, friction modification and oxidation inhibition of a lubricating oil adapatable for use as a power transmitting fluid, which comprises admixing with said lubricating oil an additive composition comprising:

(a) lubricating oil;

(b) a friction modifying amount of a hydroxyl amine compound having one of the following Formulas II or III:

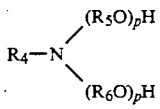

II

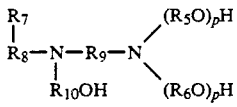

III wherein $R_4$ represents a $C_7$–$C_{28}$ saturated or unsaturated aliphatic hydrocarbon radical; $R_5$ and $R_6$ represent the same or different straight or branched chain $C_2$–$C_6$ alkylene radical; $R_7$ represents H or $CH_3$; $R_8$ represents a $C_7$–$C_{27}$ straight or branched chain alkylene radical; $R_9$ represents a straight or branched chain $C_1$–$C_5$ alkylene radical; $R_{10}$ represents a straight or branched chain $C_1$–$C_5$ alkylene radical; and p, independently, represents 1–4; and (c) an amount of an organic phosphite ester effective to impart at least anti-wear properties to the composition, said organic phosphite ester having the formula:

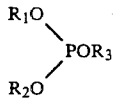

I wherein $R_1$, $R_2$ and $R_3$, independently, represent the same or different aryl or alkyl-substituted aryl hydrocarbyl radical having from about 6 to about 18 carbon atoms.

* * * * *